US006099138A

United States Patent [19]

Cardan

[11] Patent Number: 6,099,138

[45] Date of Patent: Aug. 8, 2000

[54] SEARCH PROBE

[76] Inventor: Philip Cardan, 12413 Linda Flora Dr., Ojai, Calif. 93023

[21] Appl. No.: 09/059,674

[22] Filed: Apr. 13, 1998

[51] Int. Cl.[7] ..... F21V 33/00

[52] U.S. Cl. ..... 362/109; 362/119; 362/202; 362/253

[58] Field of Search ..... 362/109, 119, 362/120, 253, 202; 294/1.1

[56] References Cited

U.S. PATENT DOCUMENTS

| | | | |
|---|---|---|---|
| 1,094,855 | 4/1914 | Keith | 362/119 |
| 1,364,873 | 1/1921 | Fitzgerald | 362/119 |
| 2,413,484 | 12/1946 | Berger | 362/119 |
| 3,839,793 | 10/1974 | Crapio | 362/319 |
| 3,900,924 | 8/1975 | Meltzner | 362/109 |
| 5,023,761 | 6/1991 | De Lange | 362/120 |
| 5,313,376 | 5/1994 | McIntosh | 362/119 |

*Primary Examiner*—Thomas M. Sember
*Attorney, Agent, or Firm*—Marvin E. Jacobs

[57] ABSTRACT

A probe for safely searching pockets for sharp or otherwise dangerous objects comprises a probe having a smooth and rounded tip attached to a flashlight. In use, the probe is inserted into portions of the suspect's clothing where potentially dangerous objects may be hidden. Objects are located by the sound generated when the probe contacts the object. Identification of the object is facilitated with the aid of the attached flashlight. The probe aids law enforcement personnel who must search criminal suspects for sharp objects such as knives, razor blades, and hypodermic needles which may be hidden in the suspect's pockets, clothing seams and so forth.

11 Claims, 1 Drawing Sheet

SEARCH PROBE

TECHNICAL FIELD

The present invention relates to a probe which is used to safely search pockets and more particularly to search pockets of suspected criminals for weapons, needles and other potentially dangerous objects.

BACKGROUND OF THE INVENTION

There are many situations in which it is desirable, even imperative, to isolate and protect those searching for potentially dangerous objects in the clothing of criminal suspects. In law enforcement fields, police officers frequently need to search the clothing and possessions of suspected criminals for guns, knives, razors, needles, drug containers and many other potentially dangerous objects. Standard "pat down" procedures can be very dangerous to the law enforcement officer. Weapons can discharge, and of course knives, razors and needles can easily cut the officers during the pat down. The risk to these law enforcement offers is now multiplied with the widespread existence of HIV positive and hepatitis carriers.

Standard pat down procedures using the officer's hands may also smudge fingerprints or otherwise disturb potentially useful evidence. Using standard manual pat down methods for searching a suspected criminal by an officer of the opposite sex also exposes the officer to allegations of improper sexual contact during the pat down process.

Similar problems exist for searching baggage, containers, refuse, ashes, and so forth for weapons, illicit material or evidence. There is an urgent need to isolate and preferably increase the sensitivity of the search process to the objects of the search.

List of References

| Patent No. | Patentee |
|---|---|
| 1,274,547 | Hohle |
| 1,364,873 | Fitzgerald |
| D125,320 | Whyte, et. al. |
| 3,153,267 | Rowland |
| D215,984 | Fattori, et. al. |
| 3,900,924 | Meltzner |
| 5,023,761 | de Lange |
| D353,011 | Miller |
| D364,694 | Silvia |
| 5,556,150 | Ampel |

STATEMENT OF THE PRIOR ART

The relevant prior art encompasses a multipurpose probe for detecting and handling hidden objects and a variety of tools attached to flashlights, particularly tongue depressors. Ampel (U.S. Pat. No. 1,274,547) describes a pliers like device preferably formed of composite materials that can be used to detect hidden objects in pockets of suspected criminals by the "vibrations" generated by tapping the objects and sensed by the user. Once an object is located, this device provides a pair of pivotably coupled elements to reach into the pocket and grasp, in pliers like fashion, and remove the object. In this manner, the object is located and removed from its hidden location. Ampel fails to recognize and provide for the critical need to illuminate the detected object so it may be identified prior to removal from its hidden location. Ampel also optimizes his design on the "pliers" aspect for grasping and removing the object rather than the critical detection and identification phase of the search operation. The bulky structure of the grasping apparatus severely compromises the search process by not being able to penetrate into small spaces, such as the pockets of tightly fitting jeans. The lack of any significant longitudinal extent of the grasping device and its inflexibility further degenerates its utility for searching for hidden and unidentified objects. By not optimizing on the search phase, dangerous objects may remain undetected.

Many implements have been disclosed that incorporate a flashlight in some fashion with a work implement. The most common of these disclosures is associated with tongue depressors. For example Hohle (U.S. Pat. No. 5,556,150) describes a tongue depressor (wooden splint) having a flashlight which serves as an "instrument handle". The device also includes an adapter suitable for two different sized tongue depressors. Fitzgerald (U.S. Pat. No. 1,364,873) describes a "throat lamp and tongue depressor" that uses a bent wire as the tongue depressor which further can be extended as needed for the examination at hand. Rowland (U.S. Pat. No. 3,153,267) discloses a clip device for interconnecting a standard tongue depressor and a small flashlight with claimed benefits of improved usability and ease of cleaning and sterilization. Fattori et. al. (U.S. Pat. No. D215,984) show a design for a penlight and tongue depressor holder. Meltzner discloses an oral examination device which also comprises a tongue depressor and disposable flashlight.

Other tools that incorporate a flashlight are disclosed by Miller (U.S. Pat. No. Des. 353,011) and Silvia (U.S. Pat. No. Des. 364,694). Miller shows a penlight having a bracket that supports a pivotable knife blade. This knife has a sharply pointed end and an opposite end connected to the pivot. The relationship of the parts is such that in the folded position the sharpened edge of the blade is contained in a slot in the flashlight bracket. When the blade is pivoted and extended forward, the pointed end of the knife blade is aimed in the same direction as the beam from the activated flashlight.

Silvia's disclosure includes a flashlight housing with a pair of screwdriver ends pivotably attached to the housing near one of its ends. The shanks of the screwdrivers, in the folded or stowed position, rest in longitudinal grooves in the surface of the housing. When a screwdriver is used, the screwdriver shank pivots away from the flashlight housing so that the end of the screwdriver has good access to the work object. Interestingly, the arrangement shown in Silvia's design has the screwdriver shank extending in a direction opposite to the direction of the light beam. Thus this device is designed to be used as either a screwdriver, or a flashlight, but not both simultaneously. In this design, an extended screwdriver shank cannot be illuminated with the flashlight to which it is attached.

As is clear from the above discussion, although flashlight augmented tools have been used in a variety of applications since first disclosed almost 80 years ago, the art is silent with respect to providing an illumination source integral with a search probe for the detection and location of weapons, needles, drug containers and other potentially harmful devices.

STATEMENT OF THE INVENTION

The search probe of this invention comprises a flashlight, a search blade with an elongated form including a handle end and a probe end having a rounded shape. A handle clip may also be provided for attaching the flashlight portion to the handle end of the search blade. The handle clip serves the threefold purpose of 1) providing a removable connection of the flashlight and the search blade, 2) providing a handle with which to grip and control the search probe and 3) providing a means to attach the search probe to a utility belt or other object for its storage.

The search blade is designed and constructed to be flexible and bendable to facilitate its use in unusually shaped search areas, such as front and rear pockets in clothing. It is preferred that the probe end of the search blade be rounded, smooth and all edges fully relieved. Thus designed and manufactured the search probe will not damage the search object, puncture or tear clothing or harm a person being searched. Stainless steel is the preferred material of construction. However, other metals and even composites are acceptable.

In use on a person, the probe is used instead of one's hands to "pat down" the suspect for weapons, needles, and other illicit materials. The pat down can be done with the probe outside the suspect's clothing or it may be inserted into pockets, hems, cuffs, linings or other areas where dangerous objects may be secreted. As necessary the search blade may be pre-configured by bending the probe appropriately for the area to be searched. When the probe is tapped against an object a metallic sound will be emitted thus alerting the peace officer/searcher to the presence of the object. The alert to the probe operator will be both by hearing the impact sound of the probe against the object, and/or by the vibration transmitted to the handle clip through the probe blade. Then, depending on the lighting conditions, circumstances and needs at the time, the object may be inspected prior to its removal by illuminating it with the flashlight.

Of course the search probe is also of use for searching baggage, parcels, or even rubbish or ashes for hidden objects. The detection method is the same, that is by hearing the sound of the impact of the probe blade against the search object, and/or feeling the vibrations in the hand of the operator through the handle end of the probe. As necessary, the located object may be readily illuminated by the flashlight for its visual identification.

When not in use the search probe may be conveniently stowed in a pouch secured to the utility belt of a law enforcement official. Alternatively, a ring may be provided on the handle clip that can be used with a snap shackle or other conventional quick release device to secure the probe to the belt.

These and many other features and attendant advantages of the invention will become apparent as the invention becomes better understood by reference to the following detailed description when considered in conjunction with the accompanying drawings.

DETAILED DESCRIPTION OF THE INVENTION

Figure 4:
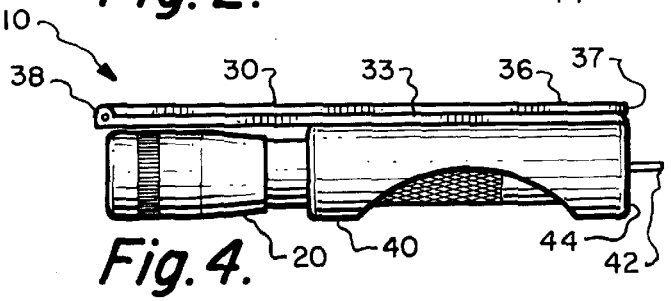
FIG. 4 is a side elevational view of the search probe shown with the blade in folded position.
Figure 5:
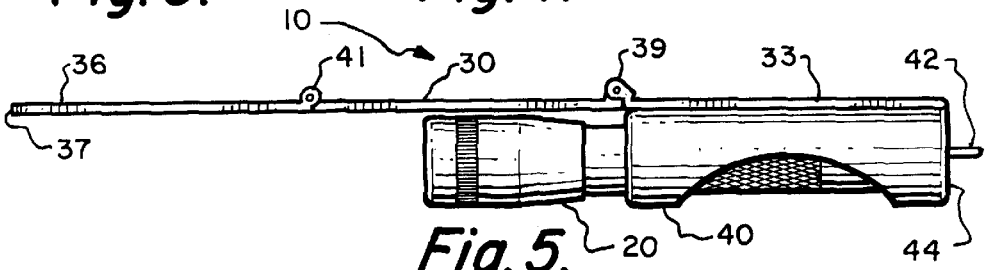
FIG. 5 is a side elevational of an alternate embodiment of a search probe with two hinge joints.
Figure 6:
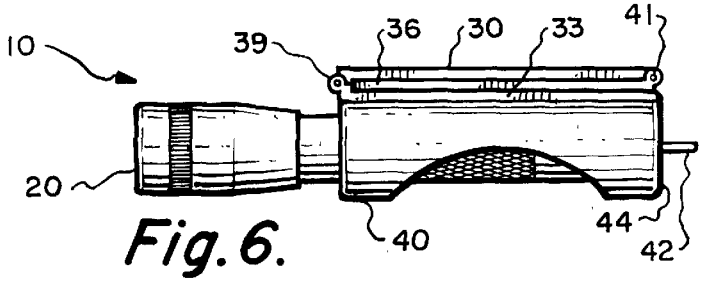
FIG. 6 is a side elevational view of the search probe of FIG. 5 shown with the blade folded.

Referring now to FIGS. 1 to 4, the preferred embodiment of the inventive search probe 10 comprises a light source such as a flashlight 20, a search blade 30 having an elongated form including a handle end 33 and a probe end 36. The probe end 36 has a rounded shape 37. The search probe 10 further includes a handle clip 40 for attaching the flashlight 20 to the handle end 33 of the search blade 30. The search blade 30 may also incorporate hinge joint 38 to provide a more compact stowage configuration for of the search probe 10. FIGS. 1 to 4 depict the preferred embodiment of blade 30 with a single hinge joint 38 whereas FIGS. 5 and 6 show a blade 30 having two hinge joints 39, 41. FIG. 4 shows the probe 10 with a single hinge joint 38 with the blade 30 in the stowed condition. FIG. 6 shows probe 10 with a double hinge joints 39, 41 and the blade 30 in the stowed position. Certain searching or probing applications may be best performed using a search probe 10 with a single piece search blade, that is one with no hinge joint (not shown). Such would be the case if increased rigidity of the blade 30 is required and the convenience of compact storage afforded by the hinge joints is not essential.

Continuing reference to FIGS. 1 to 6, it is preferred that the probe end 36 of the search blade 30 have a rounded shape 37 and that all edges of the entire probe end 33 be fully relieved and completely smooth. This can be accomplished by chamfering the edges or machining a quarter round section on each of the four edges followed by a burnishing or buffing process. Thus designed and manufactured the search probe 10 will not damage the search object, puncture or tear clothing or harm the person being searched.

Figure 1:
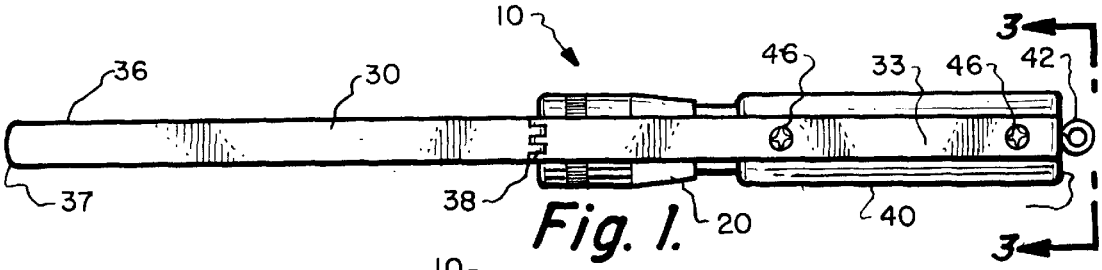
FIG. 1 is a top plan view of a search probe according to the invention with a single hinge joint showing the blade extended.
Figure 2:
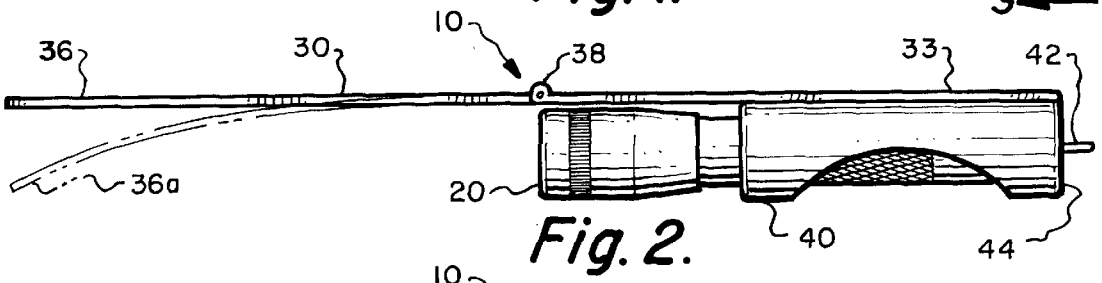
FIG. 2 is a side elevational view of the search probe with the blade bent into an alternate position as illustrated in dotted lines.
Figure 3:
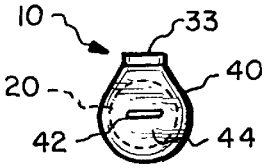
FIG. 3 is a rear elevational view taken along line 3—3 of FIG. 1.

The search blade 30 is preferably manufactured from a stainless steel alloy to provide high strength, flexibility and bendability. Depending on the user's application of the search probe, other materials may be suitable. Certainly other metals, for example aluminum, brass, and titanium may be used. On occasion a hard synthetic resin plastic or a resin fiber composite non-metallic material may be called for by the specifics of the user's need. FIG. 2 shows the probe end 36*a* bent into an alternate configuration to aid in a specific search process. Of course, there is an infinite number of configurations that the search blade 30 can be formed into, either during the manufacturing process or by the user. For applications requiring permanently formed shapes, such as that shown by the phantom lines in FIG. 2, the user will find that the use of hinge joints 38 may not be advantageous because the bent shape may compromise the compact stowage of the search blade 30 as would be the case with a straight search blade 30 as shown in FIGS. 1 to 6.

It is also possible that the hinged search blade 30 may also be provided with a means to lock the search blade 30 in the unfolded, open positioned. This may be accomplished by a wide variety of existing blade lock mechanisms that are frequently used in pocket knives. Usually such mechanisms lock automatically when the blade is in the fully open position and are quickly released by pressing a small button or release spring.

The flashlight 20 can be of any design or manufacture however the standard "Mag Lite" ™ is preferred.

The handle clip 40 which attaches the search blade 30 to the flashlight 20 is a tubular section 44 formed from any of a variety of materials. In the preferred embodiment, the selected material is an aluminum alloy however stainless steel or a rigid plastic material are also suitable. The flashlight 20 is simply inserted into the handle clip 40 and retained by an interference fit. Alternatively, the tubular section 44 of handle clip 40 can have a longitudinal slit opposite the side to which the search blade 30 is mounted. The longitudinal slit provides a spring like action of the handle clip 40 acting on the flashlight 20 to enhance the gripping action of the handle clip 40 on the flashlight 20. Handle clip 40 may optionally be fitted with a means for attaching the clip 40 to the utility belt of a police officer. FIGS. 1 to 6 show a simple ring 42 to which a variety of conventional attachment devices may be connected to secure the search probe 10 to a utility belt.

In the preferred embodiment, the search blade 30 is attached to the handle clip 40 by screws 46 secured through the blade 30 into the handle clip 40. It is also acceptable to adhesively bond the search blade 30 to the handle clip 40, suitably with an epoxy adhesive. The search blade 30 may also be secured to the handle clip 40 by inserting the blade 30 into a longitudinal slot provided in the handle clip 40. In this example, the blade 30 is retained by a suitable interference fit, or by retaining pins that can merely be depressed to release the blade 30 from the handle clip 40.

In use, the police officer or search person will unfold the search blade 30 from its stowed position in the handle clip 40 to its fully extended and open position. If the area to be searched so demands, the operator will then bend the blade 30 into the optimal shape for the search at hand. And of course if in use the shape requires adjustment, that is easily accomplished in a few seconds. After the blade has the desired shape, the searcher inserts the blade 30 into the area to be searched. When the blade 30 contacts an object, a metallic sound will be heard. Also vibrations or reverberations from the contact of the blade 30 with the object are transmitted up to the handle clip 40 where they are felt by the operator. Both the sound and the vibrations resulting from the contact will alert the searcher of the existence and location of an object. Usually the next step for the searcher is to identify the object, usually prior to its withdrawal from its secreted location. In such instances, the searcher likely will not be able to see the object because it will probably be shielded from available light. In this situation, or at night, the flashlight 20 of the probe 10 is activated. Because the axis of the flashlight 20 is exactly aligned with the search blade 30, the secreted object is illuminated and a visual identification can be made.

At this point the searcher has the information needed to determine the risk associated with withdrawal of the object. Appropriate tools can then be selected for safe and secure removal of the secreted object.

It is to be realized that only preferred embodiments of this invention have been described, and that numerous substitutions, modifications, alterations, and applications are permissible without departing from the spirit and scope of the invention as defined in the following claims.

What is claimed is:

1. A search probe for locating hidden objects in fabric lined areas of a subject's clothing being searched comprising:

a flashlight;

an elongated thin, flat metal search blade having a handle end and a probe end, said probe end having a rounded completely smooth contour, all exposed edges of the blade being fully relieved;

a handle with clip on the handle end for attaching said flashlight to the handle end of said search blade;

said search blade having at least one hinge joint positioned between said handle end and said probe end whereby said search blade may be folded for more convenient and compact storage.

2. A search probe according to claim 1 wherein said search blade is flexible whereby it can conform to the area being searched.

3. A search probe according to claim 1 wherein said search blade is bendable whereby it may pre-configured to conform to the area being searched.

4. A search probe according to claim 1 wherein said search probe further includes a means for attaching said search probe to a belt.

5. A search probe according to claim 1 wherein the metal is stainless steel.

6. A search probe according to claim 1 wherein said handle clip further includes a means for attaching said search probe to a belt.

7. A method for locating hidden objects comprising the steps of:

inserting a search probe having a flat, flexible, bendable, metal search blade with a rounded, smooth probe end into the area to be searched;

contacting a hidden object with the search blade to produce a metal sound from the blade and/or vibrations;

detecting the hidden object by the sound and vibrations of the contact of the metal search blade with the hidden object transmitted to the handle from the blade during said contacting step; and wherein said search probe is attached to a flashlight and said detecting step includes activating said flashlight whereby said hidden object is illuminated and visualized.

8. A method for locating and identifying hidden objects comprising the steps of:

inserting a search probe having a bendable, flexible, flat, metal search blade having a smooth rounded fully relieved probe end into the area to be searched, said search probe further including an attached flashlight producing a light beam;

contacting a hidden object with the metal search blade of said search probe to produce a sound;

detecting the hidden object by the sound of the contact of the search blade with the hidden object;

illuminating the hidden object with the light beam from said flashlight; and identifying the hidden object illuminated by the light beam from said flashlight.

9. A method for locating and identifying hidden objects according to claim 8 wherein said detecting step further includes the step of sensing vibrations in the handle of said probe created in the blade during said contacting step and transmitted from the blade to the handle of the probe.

10. A method according to claim 8 in which the area to be searched contains, parallel panels of fabric.

11. A method according to claim 10 in which the area to be searched is a fabric lined pocket in clothing of a person being searched.

* * * * *